United States Patent [19]

Wiedmann

[11] 4,399,755

[45] Aug. 23, 1983

[54] STRUCTURE FOR AUTOMATIC TELLER MACHINE

[75] Inventor: Paul R. Wiedmann, Sewickley, Pa.

[73] Assignee: Bank Building & Equipment Corporation of America, St. Louis, Mo.

[21] Appl. No.: 292,663

[22] Filed: Aug. 13, 1981

[51] Int. Cl.[3] ..... G07F 5/00

[52] U.S. Cl. ..... 109/2; 109/24.1; 109/66

[58] Field of Search ..... 109/2, 24.1, 71, 8, 109/58, 66; 49/42; 52/29, 31, 65; 221/119; 272/8 D, 25

[56] References Cited

U.S. PATENT DOCUMENTS

| | | | |
|---|---|---|---|
| 1,992,096 | 2/1935 | Reger | 109/9 |
| 2,081,271 | 5/1937 | Ellithorpe | 109/9 |

FOREIGN PATENT DOCUMENTS

| | | | |
|---|---|---|---|
| 2741561 | 6/1978 | Fed. Rep. of Germany | 109/8 |
| 2735780 | 2/1979 | Fed. Rep. of Germany | 109/2 |
| 2334809 | 12/1975 | France | 109/8 |

*Primary Examiner*—Gene Mancene
*Assistant Examiner*—David Tarnoff
*Attorney, Agent, or Firm*—John D. Pope, III

[57] ABSTRACT

This invention relates to a structure particularly adapted for use with an automatic teller machine. More particularly this invention relates to an environmentally controlled structure particularly adapted to permit installation of an automatic teller machine at a new or existing facility or other remote site.

15 Claims, 5 Drawing Figures

STRUCTURE FOR AUTOMATIC TELLER MACHINE

As a convenience for customers, banks and other institutions involved in receiving and dispensing money have been increasingly installing automated teller machines. At first these machines were installed only at the principal premises of the institution. More recently, however, they are being installed at locations remote from the principal banking location, such as shopping centers, parking lots, building lobbies, airports, etc. These automated teller machines permit a customer to identify himself to the machine and then transact various banking transactions such as deposits, withdrawals, payments, etc. as if he were physically present in the bank. An essential factor in the selection of suitable locations for these automatic teller machines is the security of the machine. The need for security is obvious when it is appreciated that these machines will frequently contain large sums of cash. A less obvious factor is the need to closely control the environment surrounding the machine. A significant portion of the automatic teller machines is a small computer. It is this computer which requires a relatively dust free environment which can be maintained within a narrow range of temperature and humidity.

One object of the present invention is to provide a free standing structure particularly designed to house an automatic teller machine and to provide the necessary environmental protection to the machine. An additional object of the invention is the provision of a secure area to service the machine. Yet another object of the instant invention is that it does not intrude on aisle space or other passageways while the machine is being serviced. Other objects and features will be in part apparent an in part pointed out hereinafter.

The invention accordingly comprises the constructions hereinafter described, the scope of the invention being indicated in the following claims.

In the accompanying drawings, in which one of various possible embodiments of the invention is illustrated, corresponding reference characters indicate corresponding parts throughout the several view of the drawings.

Figure 1:
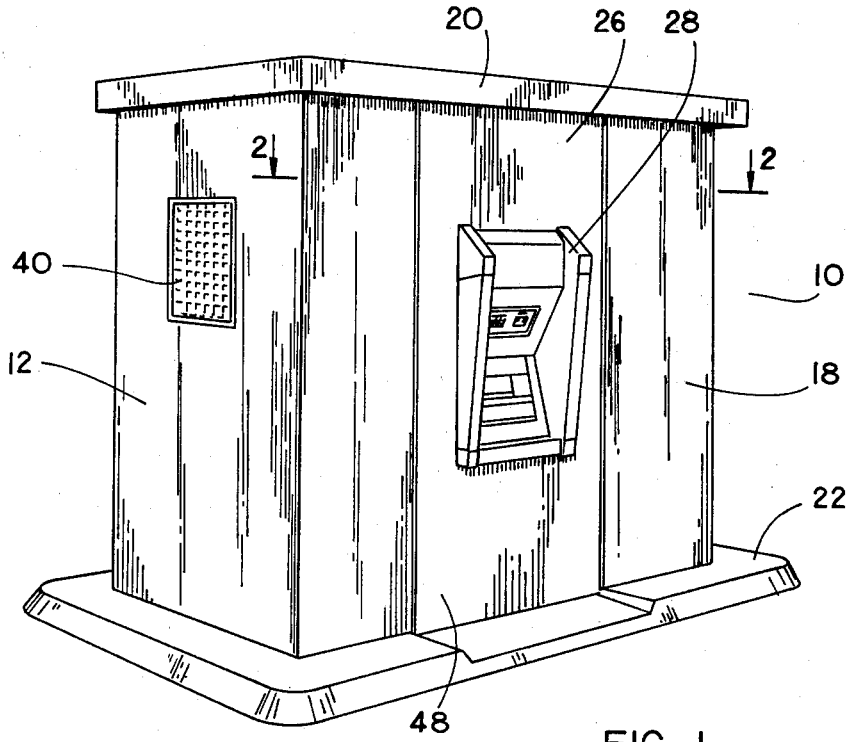
FIG. 1 is a pictorial view of one embodiment of the new and improved structure of the present invention in the configuration it would be in when in operation.
Figure 2:
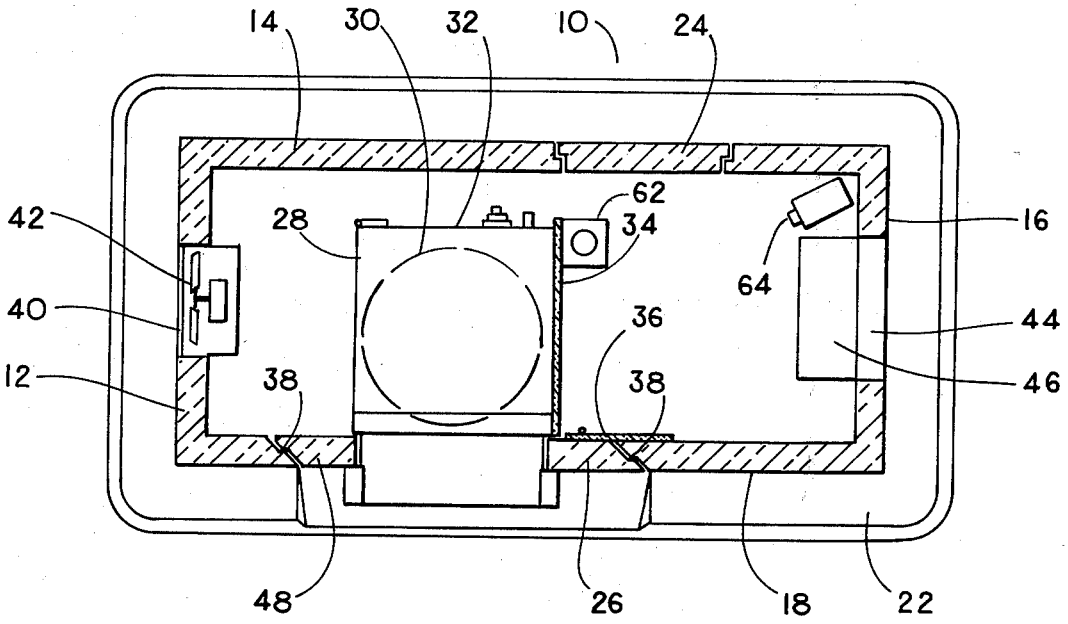
FIG. 2 is a plan view of the invention along the lines 2—2 in FIG. 1.
Figure 3:
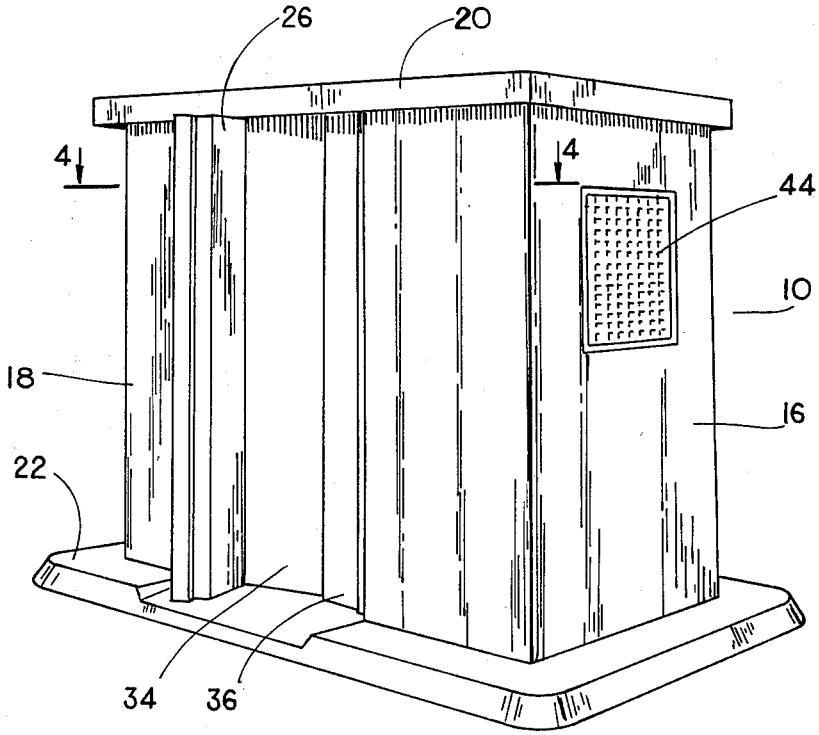
FIG. 3 is a pictorial view of the same embodiment of the invention as shown in FIG. 1 except in the configuration it would be in while being serviced.
Figure 4:
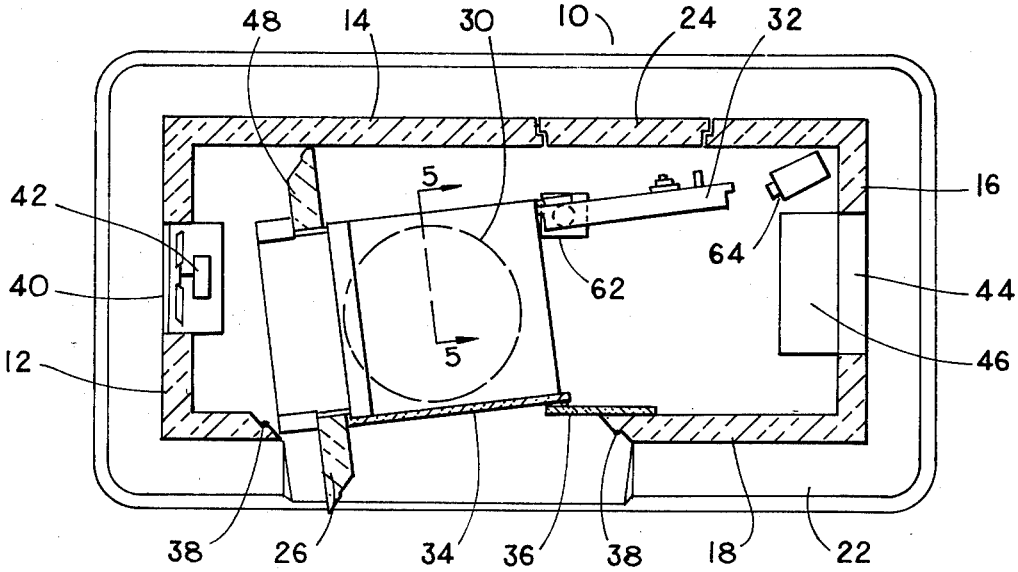
FIG. 4 is a plan view of the invention along the lines 4—4 in FIG. 3.

Referring now to the drawings, the invention comprises a free standing structure, generally designated as 10, designed to enclose an automatic teller machine. The structure 10 is particularly suited for installation at a drive-up installation and in building lobbies, shopping mails, parking lots, airports, and other areas remote from a financial institution. Unit 10 is composed of four walls 12, 14, 16 and 18 and a roof 20 mounted on a base 22 which may or may not be a portion of the structure. Intermediate in wall 18 is door 26 designed for rotatable engagement with the peripheral margins of an opening in wall 18 and particularly to engage seals 38 so as to protect the environmental integrity of the interior of the structure. Mounted in door 26 are the customer access controls of the automatic teller machine 28. The entire structure of door 26 and automatic teller machine 28 is mounted on turntable 30 (shown as a dotted circle) to permit rotation from a customer use (operative) configuration as depicted in FIGS. 1 and 2 to a servicing configuration as depicted in FIGS. 3 and 4. Included within the structure are provisions for ventilation, depicted typically by opening 40 and fan 42, and/or air conditioning, depicted by opening 44 and air conditioner 46. Wall 14 is provided with an access door 24 to permit entry into the structure for servicing automatic teller machine 28. Access door 24 can be suitably provided with any of a variety of conventional locking devices so as to assure that entry to the structure is limited to properly authorized personnel.

Examination of FIGS. 1 and 2 will reveal that, in the operative configuration, the only portion of the automatic teller machine accessable to the public is control surfaces specifically designed for such access. It will also be noted that when in the operative configuration, the service door 32 of the automatic teller machine is prevented from opening by its proximity to wall 14. FIGS. 3 and 4 depict the configuration when the automatic teller machine is being serviced by properly authorized personnel. Door 26 and automatic teller machine 28 have been rotated so that auxiliary wall 34 is engaging stub wall 36. It will be noted that the left edge 48 of door 26 is sized to be in abutting relationship with wall 14 when the automatic teller module is rotated to the servicing configuration. This produces a secure enclosure for servicing the machine comprising door 26, auxiliary wall 34, stub wall 36 and portions of walls 14, 16 and 18. Door 26 and walls 34 and 36 are all full floor to ceiling components. In addition, door 26 and auxiliary wall 34 may be provided with flexible seals (not shown) at the top and bottom so as to engage roof 20 and base 22 and thus maintain the environmental integrity of the servicing enclosure.

Figure 5:
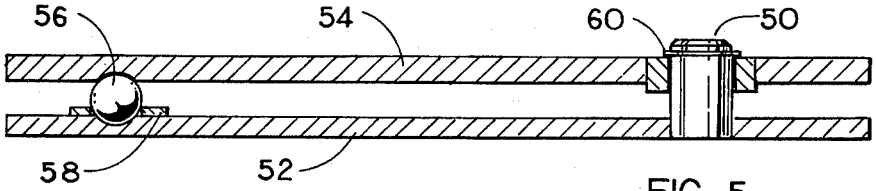
FIG. 5 is a partial sectional view of a typical turntable which would be located under the automatic teller machine.

FIG. 5 depicts a typical heavy duty turntable suitable for use in the invention. It consists of center pivot 50, bottom plate 52, top plate 54, a plurality of balls 56, ball retainers 58 and retainer ring 60. Bottom plate 52 is affixed to base 22 and top plate 54 is supported on a plurality of ball bearings 56 which are spaced about the periphery of bottom plate 52. The ball bearings are retained in the desired locations by ball retainers 58 which are affixed to bottom plate 52. Top plate 54 rotates around center pivot 50; if necessary, top plate 50 may be provided with a suitable bushing. Door 26, automatic teller machine 28 and auxiliary wall 34 are all mounted on top plate 54 so as to rotate, as a unit, from an operative configuration to a servicing configuration.

It will be appreciated that the particular details of the materials selected and the mode of construction are well within the capabilities of one skilled in the art and will vary somewhat depending upon the dimensions and weight of the particular automatic teller machine with which the structure is to be used.

The unique features of the instant invention become apparent when the method of servicing is examined. To service the unit, a properly authorized person would secure entry to the interior of the structure through access door 24. Once the service person is within the structure, he is in a totally secure environment. The service person then unlocks turntable lock 62 and rotates the unit to the servicing configuration. When the module has been rotated to the servicing configuration, service door 32 may be opened and the automatic teller machine serviced.

As will be appreciated, other conventional security features may be installed inside or outside of the structure to prevent unauthorized access to the machine. These may include closed circuit television 64, remote unlocking of door 24, service door 32, or turntable 30 and other security devices, the nature of which will be readily apparent to one skilled in the art.

The structure of applicant's invention thus offers a number of unique advantages which make it particularly suitable for use in public locations. The structure is compact and may be installed as a free standing structure without requiring allocation of additional space to permit servicing of the machine. The machine is serviced from inside the structure. This eliminates interruption of normal traffic around the machine while it is being serviced. It also drastically improves security while the machine is serviced. In addition, the unique design permits the servicing to be done within the controlled environment maintained in the structure and thus reduces the possibility of foreign material infiltrating the operative parts of the automatic teller machine during servicing. Security is further improved by the fact that the automatic teller machine service door is protected from access when the structure is in the operative configuration and thus even if an intruder obtains entry to the structure, it is not possible to obtain access to the service door without unlocking the rotation mechanism and rotating the automatic teller module from the operative configuration to the service configuration. It is thus apparent that the structure of the invention offers many unique and advantageous features which make it particularly suitable for the installation of an automatic teller machine in a public area.

Structure 10 may be suitably decorated to be compatible with its surroundings and still provide an attractive and secure enclosure for an automatic teller machine.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A structure comprising walls, a base and a roof; a component mounted upon the base adjacent to an opening in one of said walls, which component is rotatable between an operative position and a servicing position; a first panel affixed to the rotatable component so as to close the opening in said wall when the rotatable component is in the operative position; a door in one of the walls to permit entry into the structure and an automatic teller machine having customer-operated controls mounted upon the rotatable component so that the customer-operated controls are accessible through said first panel when the rotatable component is in the operative position and are inaccessible to the customer when the rotatable component is in its servicing position.

2. A structure according to claim 1 wherein the automatic teller machine has a servicing door, which servicing door is only accessible when the rotatable component is in its servicing position.

3. A structure according to claim 1 wherein a second panel substantially closes the opening in said wall when the rotatable component is in the servicing position.

4. A structure according to claim 3 wherein the first and second panels are provided with seals so that the environmental integrity of the interior of the structure is maintained when the rotatable component is in both the operative position and the servicing position.

5. A structure according to claim 4 wherein said second panel is mounted on the rotatable component.

6. A structure according to claim 1 wherein the rotatable component is provided with a locking device which precludes rotation from the operative position to the servicing position, except by properly authorized personnel.

7. A structure according to claim 6 wherein the locking device is operable from a remote location.

8. A structure according to claim 1 provided with a television transmitting device which permits monitoring of personnel within the structure from a remote location.

9. A structure according to claim 2 wherein a second panel substantially closes the opening in said wall when the rotatable component is in the servicing position.

10. A structure according to claim 9 wherein the first and second panels are provided with seals so that the environmental integrity of the interior of the structure is maintained when the rotatable component is in both the operative position and the servicing position.

11. A structure according to claim 10 wherein said second panel is mounted on the rotatable component.

12. A structure comprising walls, a base and a roof; a component mounted upon the base adjacent to an opening in one of said walls, which component is rotatable between an operative position and a servicing position; a first panel affixed to the rotatable component so as to close the opening in said wall when the rotatable component is in the operative position; a door in one of the walls to permit entry into the structure and an automatic teller machine having customer-operated controls and a servicing door mounted upon the rotatable component so that the customer-operated controls are accessible through said first panel when the rotatable component is in the operative position and are inaccessible to the customer when the rotatable component is in its servicing position and wherein the servicing door is only accessible when the rotatable component is in its servicing position.

13. A structure according to claim 12 wherein a second panel substantially closes the opening in said wall when the rotatable component is in the servicing position.

14. A structure according to claim 13 wherein said second panel is mounted on the rotatable component.

15. A structure according to claim 14 wherein the first and second panels are provided with seals so that the environmental integrity of the interior of the structure is maintained when the rotatable component is in both the operative position and the servicing position.

* * * * *